US007178314B2

(12) United States Patent
Chomik et al.

(10) Patent No.: US 7,178,314 B2
(45) Date of Patent: Feb. 20, 2007

(54) WASTE DISPOSAL APPARATUS

(75) Inventors: Richard S. Chomik, Middlesex, NJ (US); Stewart Schmehl, Wayne, NJ (US)

(73) Assignee: Playtex Products, Inc., Westport, CT (US)

( * ) Notice: Subject to any disclaimer, the term of this patent is extended or adjusted under 35 U.S.C. 154(b) by 0 days.

(21) Appl. No.: 11/205,655

(22) Filed: Aug. 17, 2005

(65) Prior Publication Data

US 2006/0037289 A1 Feb. 23, 2006

Related U.S. Application Data

(62) Division of application No. 10/406,991, filed on Apr. 3, 2003, now Pat. No. 6,941,733.

(51) Int. Cl.
*B65B 43/26* (2006.01)
*B06B 1/04* (2006.01)

(52) U.S. Cl. ..... 53/459; 53/370; 53/374.6; 53/477; 53/567; 53/576

(58) Field of Classification Search ..... 53/567, 53/576, 551, 390, 459, 469, 477, 284, 370, 53/372, 374.5, 374.6
See application file for complete search history.

(56) References Cited

U.S. PATENT DOCUMENTS 3,452,368 A * 7/1969 Couper ..... 4/484
4,519,104 A * 5/1985 Nilsson ..... 4/484
4,663,917 A * 5/1987 Taylor et al. ..... 53/552
4,947,618 A * 8/1990 Schneider et al. ..... 53/374.6
6,128,890 A * 10/2000 Firth ..... 53/567
6,370,847 B1 * 4/2002 Jensen et al. ..... 53/459
6,719,194 B2 * 4/2004 Richards ..... 232/43.1

* cited by examiner

*Primary Examiner*—Louis K. Huynh
*Assistant Examiner*—Thanh Truong
(74) *Attorney, Agent, or Firm*—Ohlandt, Greeley, Ruggiero & Perle, L.L.P

(57) ABSTRACT

The present invention discloses a waste disposal apparatus including a container having a first end and a second end. A tubing cassette for supplying tubing is mounted proximate the first end of the container. A first sealing member and a second sealing member are moveable between an open position, wherein tubing from the tubing cassette can pass between the first and second sealing members, and a closed position, wherein the first and second sealing members can be activated to create a seal in the tubing. The first and second sealing members are guided by guide pins that travel along stepped channels for moving the first and second sealing members between the open and closed positions, and for pulling the tubing and waste packages through the waste disposal apparatus.

17 Claims, 8 Drawing Sheets

WASTE DISPOSAL APPARATUS

RELATED APPLICATIONS

This application is a division of, and claims priority in, U.S. patent application Ser. No. 10/406,991, filed Apr. 3, 2003 now U.S. Pat. No. 6,941,733, the disclosure of which is incorporated herein by reference.

BACKGROUND OF THE INVENTION

1. Field of the Invention

The present invention relates generally to a waste disposal apparatus and, more particularly, to an apparatus particularly suited for the sanitary and odorless disposal of waste such as soiled diapers.

2. Description of the Related Art

There are a number of systems for disposing of waste materials such as soiled diapers. The systems are often touted as a convenient way to dispose of such waste materials and reduce or eliminate any odor that may emanate from the materials. An example of such systems is U.S. Pat. No. 5,147,055 which discloses a diaper container that includes an activated charcoal filter to retain and absorb orders within the container.

European patent application No. 0005660, the contents of which are incorporated by reference herein, describes a device for disposing kitchen refuse in packages enclosed by flexible tubing derived from a tubular pack of tubing surrounding a tubular guide. The device includes a tube sealing mechanism. The tubing passes from the pack over the top of and then down the guide to a position beneath the guide where it has been closed by fusion to provide a receptacle within the guide means. When this receptacle is full of refuse, a lever is manually operated to actuate an electromechanical apparatus including clamping and fusion devices that travel round closed tracks to perform the four-fold task of drawing the receptacle down below the tubular guide, fusing the tubing walls together to seal the top of the receptacle, sealing the tubing walls together to provide the closed base of the next receptacle and dividing the tubing by heat at a location between these two fusion locations to separate the filled package. There are a number of disadvantages with this device including the need for latches to prevent the wheels extending from the heating elements from inadvertently returning up the central track portions (as opposed to following the outer track portions as they should. A further disadvantage is that the heating element must be at least the width of the tube in order to seal the tube all the way across thereby preventing, for example, the escape of odors from the waste.

Another device for use in disposing of diapers is disclosed in U.S. Pat. No. 6,370,847 to Jensen, et al., and U.S. Pat. No. 6,516,588 to Jensen, et al., the contents of which are incorporated by reference herein. The devices disclosed include tube sealing mechanisms. These related patents disclose a sealable diaper-disposal system that includes a container body 44, a tubular core 63 in which flexible tubing 62 is stored, and a pair of heating elements 76 and 78. The tubing 62 extends between two sealing members 76 and 78 that are operable to move toward each other to seal across the width of the tubing 62 and away from each other to allow the tubing 62 to be pushed into the lower portion of the container body 44. A disadvantage of the Jensen system is that the soiled diaper must be pushed into the device beyond the tubular core 63 and the separated sealing members 76 and 78 so the sealing members can seal the tubing 62 to form a closed package with diaper enclosed. A further disadvantage is that the heating elements 76 and 78 must be at least the width of the tubing 62 in order to seal the tubing all the way across.

Another popular approach to disposing of such diapers has been with a device using a tube twisting mechanism to form a pouch about the diaper. As an example, see the disclosures of U.S. Pat. Nos. 4,869,049, 5,590,512, 5,813,200, the contents of all of which are incorporated by reference herein.

The U.S. Pat. No. 5,813,200 discloses a device for disposing of soiled diapers in twisted packages. The device has a container body with a hinged base, a hinged lid, and an upward cylinder secured within the container body. A tubular core rests on a portion of the upward cylinder to allow rotation there between. A flexible tube or sleeve rests on a portion of the tubular core with the tubing being circumferentially pleated as stored. Springs are fixed to the container and project radially inward to engage a package formed from the tube. The springs are equally spaced around the interior of the container to hold the package during the forming of a twist in the tube.

The device disclosed in U.S. Pat. No. 5,813,200 is used to form a series of packages enclosing objects. The top of the flexible tubing is pulled upwards and tied into a knot. The closed end formed by the knot can then form the bottom of a package with the sidewalls formed by the tubing. The object is inserted and rests against the tubing near the knot. A rotatable interior lid is put into place and rotated such that the unused tubing and the tubular core rotate with respect to the package that is being formed. The package being formed does not rotate because it is held in place by friction between it and springs. Thus a package is formed between the knot and a first twist. Subsequently, objects are disposed and twisted in a like manner to form discrete packages with twists between them.

Devices such as that disclosed in U.S. Pat. No. 5,813,200 are a convenient way of disposing of soiled diapers. A disadvantage of the system is that the twists between packages may become unraveled, thereby allowing groups of diapers to collect within the tubing, which makes emptying the container more difficult. Further, the twists do not create a continuous, complete seal and, therefore, may allow odor to escape from a package. Increasing the twists between packages may eliminate the above disadvantages, however, this requires the use of additional tubing.

From the above it can be understood by those having ordinary skill in the art that there are a number of disadvantages associated with prior art waste disposal devices using flexible tubing to form packets for disposal of waste materials. It is clear that a device is needed that will eliminate the disadvantages described above. Such a device should be relatively economical to purchase and operate, ensure that the seals between packets are complete and cannot come undone, and be easy to operate.

SUMMARY OF THE INVENTION

The inventors of the present invention disclose a waste disposal apparatus including a container having a first end and a second end; a tubing cassette for supplying tubing, the tubing cassette mounted proximate the first end of the container; a first sealing member having ends and a second sealing member having ends, the first and second sealing members mounted to the container with their lengths in parallel relationship, positioned between the tubing cassette and the second end of the container, and moveable between an open position, wherein tubing from the tubing cassette can pass between the first and second sealing members, and a closed position, wherein the first and second sealing members can be activated to create a seal in the tubing; a first pair of guide pins each mounted to an end of the first sealing member and biased to move away from each other; a second pair of guide pins each mounted to an end of the second sealing member and biased to move away from each other; a first pair of channels between which the first sealing member is positioned and in each of which one of the first pair of guide pins travels as the first sealing member moves between the open position and the closed position; and a second pair of channels between which the second sealing member is positioned and in each of which one of the second pair of guide pins travels as the second sealing member moves between the open position and the closed position.

The inventors further disclose a waste disposal apparatus including a container having a first end and a second end; a tubing cassette for dispensing tubing, the tubing cassette mounted proximate the first end of the container and rotatable in relation to the container, said dispensed tubing being operationally positioned with respect to the container such that a twist can be formed in the tubing to form a receptacle closed on a first end, into which waste material may be placed; a retention means positioned between the tubing cassette and the second end of the container for preventing rotation of a tubing receptacle filled with waste material when the tubing cassette is rotated; and a first sealing member and a second sealing member mounted to the container between the tubing cassette and the second end of the container and moveable between an open position, wherein tubing from the tubing cassette can pass between the first and second sealing means, and a closed position, wherein a twist formed in the tubing can be sealed.

The inventors further disclose a method for disposing of waste material including the steps of providing a length of tubing having a first sealed portion of the tubing at a location along its length and an open end of the tubing; inserting waste material through the open end of the tubing until it contacts the first sealed portion of the tubing to form a waste package; retaining the waste package such that the waste package does not rotate in relation to the open end of the tubing; rotating the open end of the tubing such that a twist is formed in the tubing between the open end of the tubing and the waste package; and sealing at least a portion of the twisted tubing to form a second sealed portion.

BRIEF DESCRIPTION OF THE FIGURES

A more complete appreciation of the invention and the advantages thereof will be more readily apparent by reference to the detailed description of the preferred embodiments when considered in connection with the accompanying figures, wherein.

It is notable that similar items depicted in the figures may be given the same item number (e.g., all guide pins are identified with item number 42, all stepped channels are identified with item 48), and similar items depicted in the figures that are not specifically numbered may be referred to by the same item number (e.g., all inner channels are referred to as item 94).

DETAILED DESCRIPTION OF THE PREFERRED EMBODIMENTS

A waste disposal apparatus is disclosed for disposing of waste materials such as soiled diapers. The apparatus has improved features over prior art devices including, for example, tube twisting and sealing mechanisms that ensure the seals between packages are airtight, compact, and facilitates automation of the sealing process. Also disclosed are attributes that reduce the complexity of such mechanisms and reduce the cost to manufacture and assemble the same.

Figure 1:
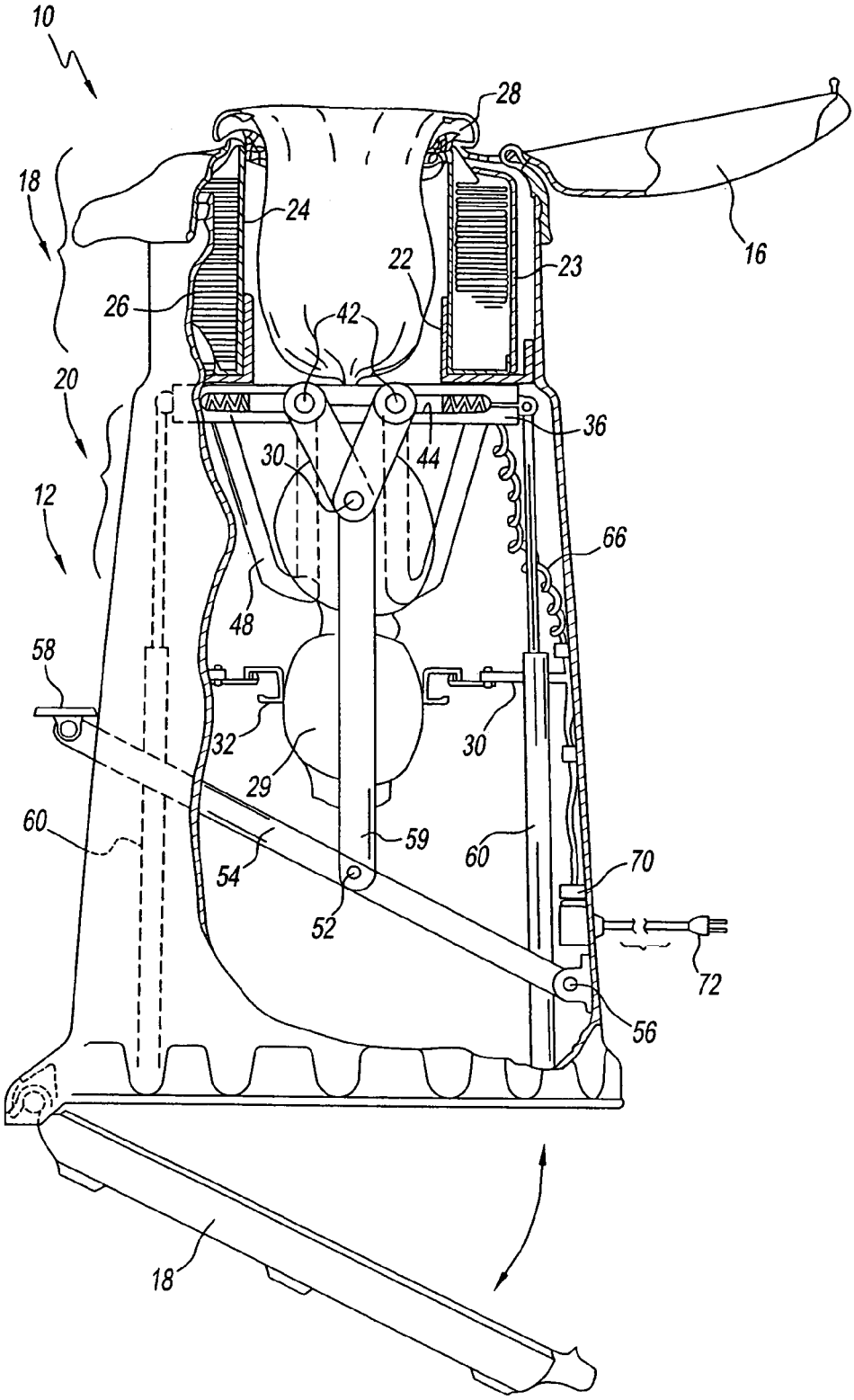
FIG. 1 is a side elevation view of an apparatus for packaging waste in individual packages distributed along a length of flexible tubing.

Referring to FIG. 1, an apparatus in accordance with an embodiment of the present invention is illustrated at 10. The apparatus 10 includes a cylindrical container 12 having a removable cover 14 at the top of the cylindrical container 12 and an access door 18 at the bottom of the cylindrical container 12. The removable cover 14 has an opening covered by a hinged lid 16. The apparatus 10 further includes a tube twisting mechanism 18 and a tube sealing mechanism 20. Specific embodiments of these mechanisms are described herein below, however, various other mechanisms that may be employed to obtain advantages (e.g., improved seals between waste packages, more economical heating element configuration) of the invention as discussed in detail herein. Exemplary tube twisting mechanisms are disclosed in U.S. Pat. No. 6,128,890 and U.S. Publication No. US 2002/0162304, the contents of all of which are incorporated by reference herein. Exemplary tube sealing mechanisms are disclosed in U.S. Pat. Nos. 6,065,272 and 6,370,847, the contents of all of which are incorporated by reference herein.

Tube twisting mechanism 18 includes a channel-shaped flange 22 that is located inside of and fixed to the cylindrical container 12, a tubing cassette 23 resting on the channel-shaped flange 22, and an inner lid 28 mounted to the tubing cassette 23. The tubing cassette 23 has a tubular core 24 and a continuous length of flexible tubing 26 stored in within the tubular core 24. An exemplary tubing cassette is disclosed in U.S. Pat. No. 4,934,529, the contents of which are incorporated by reference herein. When the inner lid 28 is rotated it causes the tubing cassette 23 to rotate in relation to the channel-shaped flange 22. Flexible tubing 26 is shown to extend from the top of the tubing cassette 23, over the inner lid 28, and through the center of the tubular core 24 of the tubing cassette 23. Waste packages 29 are shown formed at the free end of the flexible tubing 26 within the cylindrical container 12. A flat flange 30 extends from the cylindrical container 12. A plurality of retention means, for example, retention springs 32 are attached to the flat flange 30 and retain or hold a waste package 29 stationary while the inner lid 28 is rotated to twist the flexible tubing 26. As used herein, the term "retention means" shall include any retention device for retaining a waste package 29 stationary while the flexible tubing 26 is rotated. The term shall include, for example, retention devices as disclosed in U.S. Pat. Nos. 4,869,049, 5,590,512, 6,170,240, 6,128,890, 6,370,847, JP 592039015 (P2000-247401 A), and U.S. Patent Publication No. US 2002/0162304, the contents of all of which are incorporated by reference herein.

Tube sealing mechanism 20 includes a sealing member housing 36 in which a first sealing member 38 and a second sealing member 40 are housed. As described in more detail herein below, the first and second sealing members' 38 and 40 are configured to heat a twist created in the tubing 26 by the tube twisting mechanism 18. Guide pins 42 extend from the first and second sealing members 38, 40, protrude through longitudinal openings 44 in the sealing member housing 36, protrude through the upper ends of guide links 46, and engage with stepped channels 48. The stepped channels 48 are formed in base plates 49 which are attached to the cylindrical container 12.

The lower end of the guide links 46 are pivotally attached by pivot pins 50 to the upper ends of pull bars 51. The lower ends of the pull bars 48 are pivotally attached by pivot pins 52 to an actuation lever 54, which is pivotally attached by one end to the cylindrical container 12 by pivot pins 56 and its other end extends through the sidewall of the cylindrical container 12. A pedal 58 is attached to the end of actuation lever 54 that extends out of the cylindrical container 12. Pneumatic spring cylinders 60 are connected between the sealing member housing 36 and the cylindrical container 12.

It is notable that the term "waste package" is used broadly herein to describe flexible tubing enclosing waste material and sealed on one end of the package (e.g., the "waste package" formed above the sealing member housing 36 with only one end of the package sealed), or flexible tubing enclosing waste material and sealed on both ends of the package (e.g., the "waste packages" 29 formed below the sealing member housing 36 with both ends of the package sealed).

Figure 2:
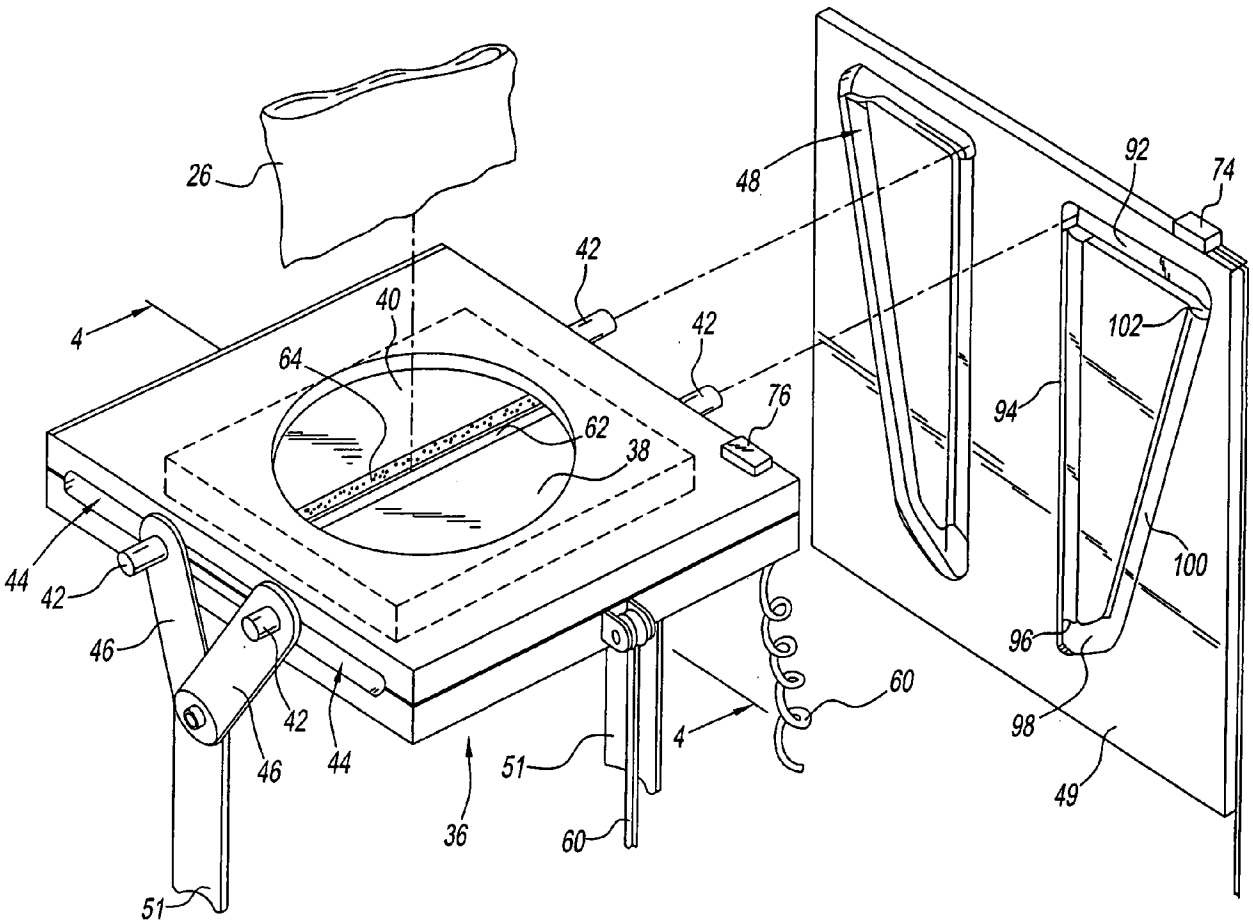
FIG. 2 is a perspective view of the sealing mechanism shown in FIG. 1.

Referring to FIGS. 1 and 2, in one embodiment of the invention the first sealing member 38 includes a heating element 62 and the second sealing member 40 includes a backing element 64. Of course, the first and second sealing element may, in an alternative embodiment, both be heating elements. When the heating element 62 and backing element 64 are in contact, or the closed position, the heating element 62 is sufficiently pressed against the backing element 64 and energized so that a seal forms in the flexible tubing 26. The sealing in the embodiments of FIGS. 1 and 2 is performed through thermal heating of the flexible tubing 26, however, as would be understood by one of ordinary skill in the art, sealing may also be obtained by ultrasonic techniques, application of adhesive to the tubing, activation of adhesive in the tubing material, or other sealing techniques. The heating element 62 is powered through an electrical cord 66 attached to a transformer 68 through a timing switch 70. The transformer 68 receives power from a standard 115 volt outlet through a standard electrical cord and plug 72. Alternative power sources may be provided. A magnetically activated proximity switch 74 is mounted to the top of one of the base plates 49. The proximity switch 74 is connected to the timing switch 70 for activating the switch 70, which in turn activates the heating element 62 for a predetermined amount of time to seal the flexible tubing 26. The proximity switch 74 is activated by a magnet 76 that is attached to the top of the sealing member housing 36.

Figure 3:
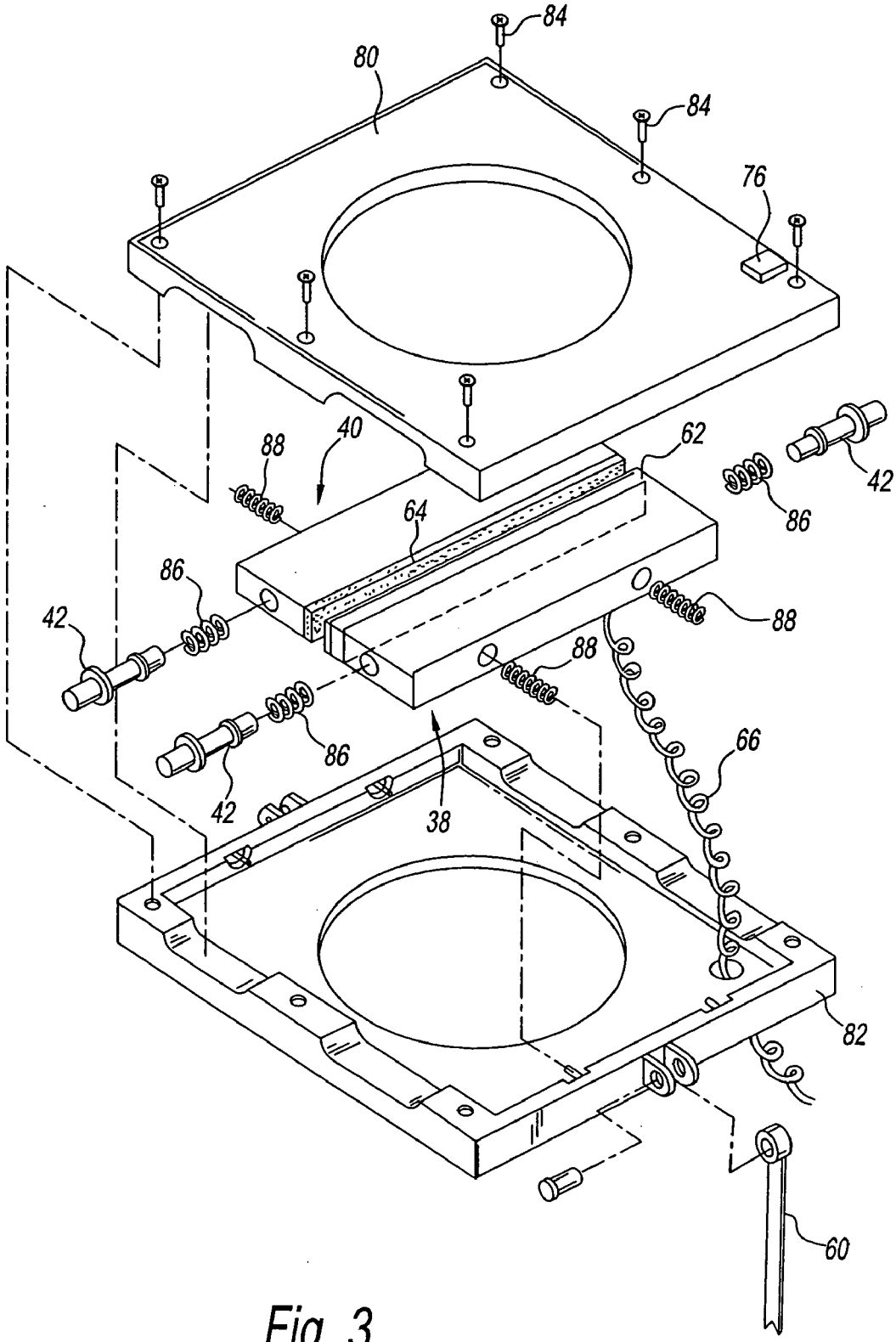
FIG. 3 is an exploded view of the sealing member housing and associated components shown in FIG. 2.

Referring to FIG. 3, an exploded view of the sealing member housing 36 of FIG. 2 and associated components is shown. The sealing member housing 36 of such embodiment includes an upper half 80 and a lower half 82, which are fastened together with fasteners 84. The first and second sealing members 38, 40, having length approximately equal to "L" (the width of the first and second sealing members 38, 40) are slidingly assembled between the upper and lower halves 80, 82 of the sealing member housing 36. Springs 86 urge the guide pins 42 out of their mounting holes in the first and second sealing members 38, 40, and toward the bottoms of their respective stepped channels 48. Springs 88 urge the first and second sealing members 38, 40 toward each other.

Figure 4:
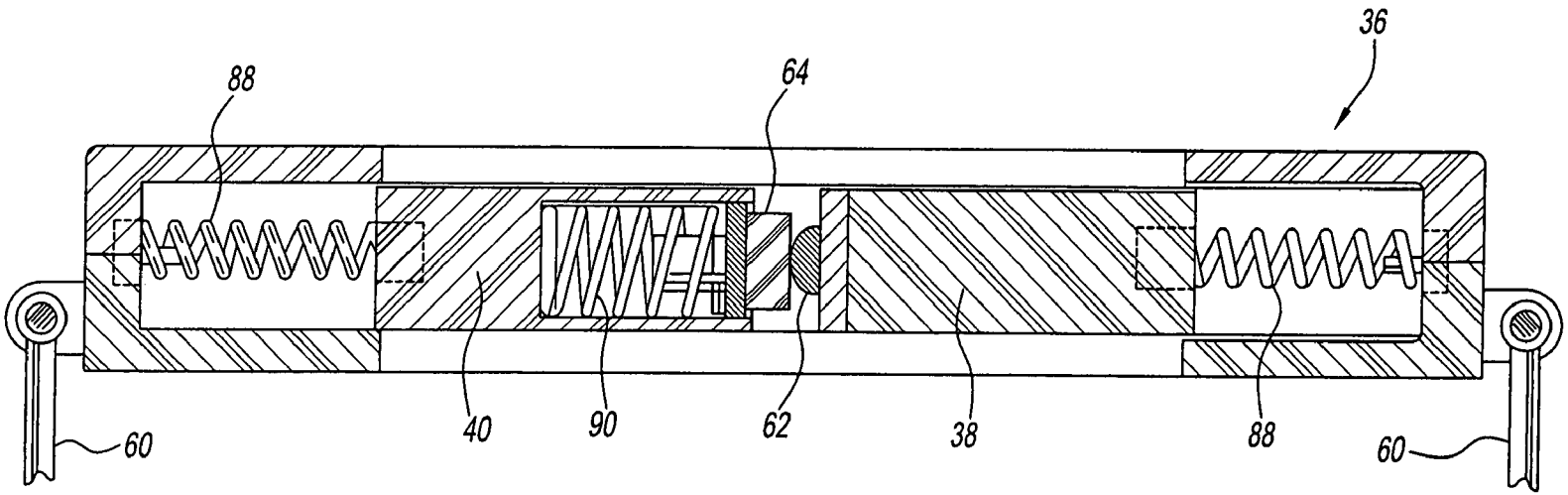
FIG. 4 is a cross-sectional view of the sealing member housing and associated components shown in FIG. 2.

Referring to FIG. 4, a cross-sectional view of the sealing member housing 36 and associated components is shown. The first and second sealing members 38, 40 are urged toward each other by springs 88, thereby causing heating element 62 to contact backing element 64. Backing element 64 is also separately urged by springs 90 against heating element 62. This arrangement enables more precise adjustment of pressure between the backing element 64 and the heating element 62, and also compensates for tolerance inaccuracies between the components (e.g., tolerance inaccuracies between the stepped channels 48). Alternatively, heating element 62 can be separately urged by a spring (not shown) against backing element 64 (which may or may not be spring loaded) to provide the same advantages.

Referring to FIG. 2, the stepped channels 48 include ramps and steps to ensure that each pair of guide pins 42 mounted to the first and second sealing members 38, 40 travel around the stepped channels 48 in the same direction. It should be readily apparent that all four of the stepped channels 48 include similar features. Considering one stepped channel 48 (the right-hand stepped channel in FIG. 2) and following the path that a guide pin 42 would travel during operation of the tube sealing mechanism 20, an upper channel 92 has a relatively flat bottom and is about horizontal. When the tube sealing mechanism 20 is activated by a user (e.g., by stepping on pedal 58, FIG. 1), the sealing member housing 36 is urged downward. Consequently, guide pin 42 follows an inner channel 94 downward. Inner channel 94 is tapered inward (i.e., toward the sealing member housing 36), thereby causing guide pin 42 to be pressed into the first sealing member 38 against the bias of spring 86. The inner channel 94 intersects a lower channel 96. The lower channel 96 is at about the same depth as the upper channel 92, therefore a step 96 is formed between the inner channel 94 and the lower channel 98. As the guide pin 42 travels over the step 98, it snaps outwardly (i.e., away from the sealing member housing 36). When the sealing member housing 36 is allowed to travel upward (e.g., by releasing pedal 58, FIG. 1), the guide pin 42 travels upwardly due to the bias of the pneumatic springs 60 against sealing member housing 36. Because of the step 98 between inner channel 94 and lower channel 96, and the angle of lower channel 96, the guide pin 42 follows lower channel 96 to an outer channel 100. Outer channel 100 is tapered inward (i.e., toward the sealing member housing 36), thereby causing guide pin 42 to be pressed into the first sealing member 38 against the bias of spring 86. The outer channel 100 intersects the upper channel 92. A step 102 is formed between the outer channel 100 and the upper channel 92. As the guide pin 42 travels over the step 102, it snaps outwardly (i.e., away from the sealing member housing 36). Thereafter springs 88 urge the first and second sealing members 38, 40 toward each other.

Guide pin 42 travels in upper channel 92 until it contacts the end of the channel (i.e., at the intersection of the upper channel 92 and the inner channel 94).

Referring to FIGS. 5–9, there is shown sequentially a sealing cycle embodiment of the invention. In such sealing cycle the flexible tubing 26, any waste contained therein, and any waste package 29 attached thereto are pulled downwardly into the lower portion of cylindrical container 12; the first and second sealing members 38, 40 are separated to move upwardly past the waste-filled flexible tubing 26; the first and second sealing members 38, 40 are urged toward each other so the heating element 62 and backing element 64 are in contacting relationship; and the heating element is energized to seal the flexible tubing 26, thereby forming a waste package 29.

Figure 5:
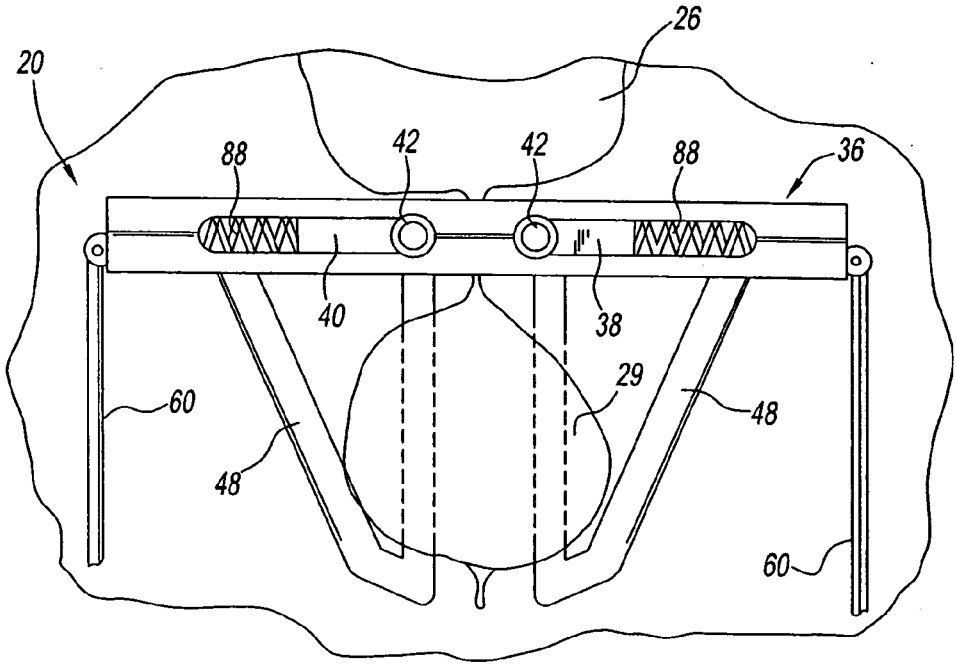
FIG. 5 is a side elevation view of a tube sealing mechanism in a start/end position.

Referring to FIG. 5, there is shown yet another embodiment wherein the tube sealing mechanism 20 is in the start position. That is, sealing member housing 36 is shown in a start position, for example, a user has not pressed the pedal 58 downwardly, wherein the pneumatic springs 60 maintain the sealing member housing 36 in the upper position; the first and second sealing members 38, 40 are urged toward each other by springs 88; the guide pins 42 are positioned in the stepped channels 48 at the intersection of the upper channels 92 and the inner channels 94; and the heating element 62 and backing element 64 grip a sealed portion of the flexible tubing 26 between a waste-filled portion of the flexible tubing 26 positioned above the heating element 62 and backing element 64, and a waste package 29 positioned below the heating element 62 and backing element 64.

Figure 6:
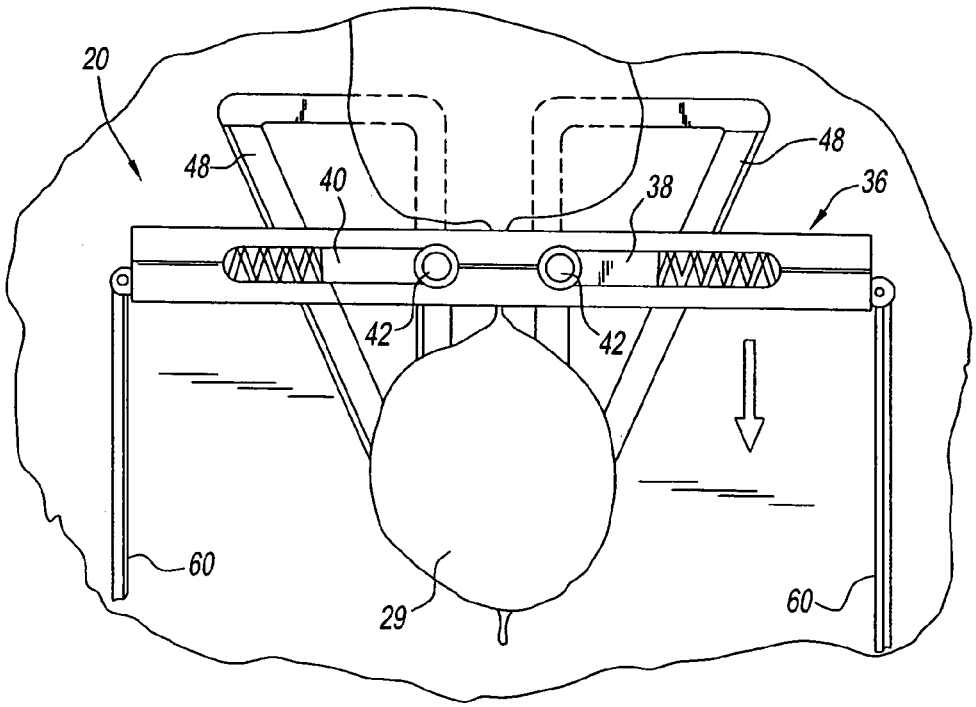
FIG. 6 is a side elevation view of a tube sealing mechanism in a partially lowered position.

Referring to FIG. 6, the tube sealing mechanism 20 is shown just after having been actuated, for example, by a user stepping on pedal 58 (FIG. 1). That is, the sealing member housing 36 is shown in a partially lowered position, wherein the pneumatic springs 60 are partially compressed; the first and second sealing members 38, 40 are urged toward each other by springs 88; the guide pins 42 are positioned in the stepped channels 48 in inner channels 94, partially pressed into the first sealing member 38 and the second sealing member 40 because of tapers in inner channels 94; the heating element 62 and backing element 64 grip a sealed portion of the flexible tubing 26 between the waste-filled portion of the flexible tubing 26 positioned above the heating element 62 and backing element 64, and the waste package 29 positioned below the heating element 62 and backing element 64; and the flexible tubing 26, waste contained therein, and waste package 29 attached thereto are pulled downwardly toward the lower portion of cylindrical container 12.

Figure 7:
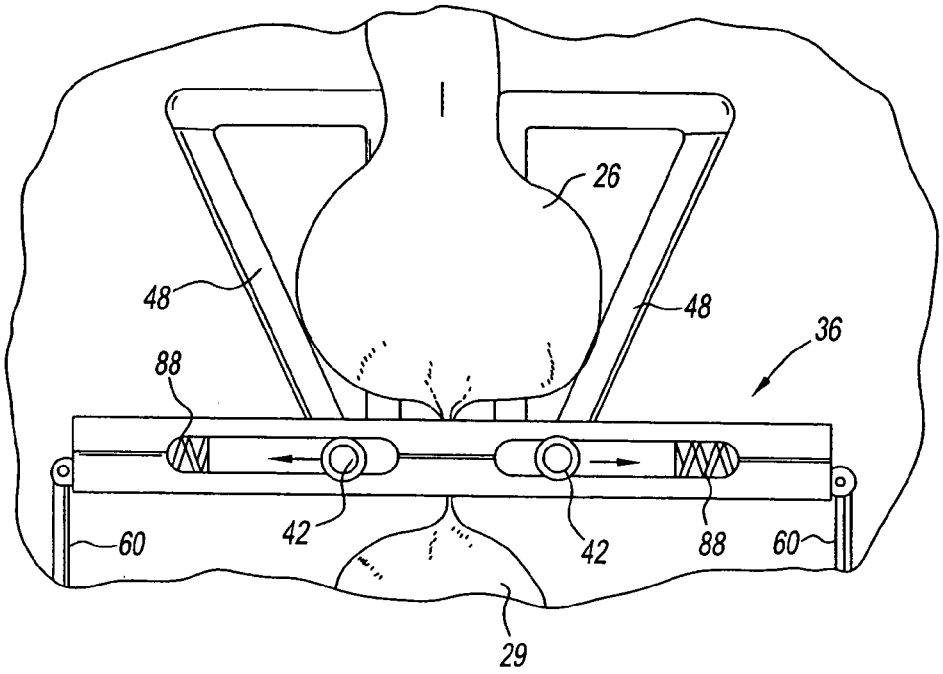
FIG. 7 is a side elevation view of a tube sealing mechanism in a lowered position.

Referring to FIG. 7, the tube sealing mechanism 20 is shown in a lowered position after having been fully actuated and released, for example, where a user pressed pedal 58 completely downwardly and just released the pedal 58 (FIG. 1). That is, the sealing member housing 36 is shown in a lowered position, wherein the pneumatic springs 60 are about fully compressed; the first and second sealing members 38, 40 are separating because guide pins 42 are positioned in stepped channels 48 in lower channels 96 moving toward outer channels 100 due to the force exerted by pneumatic springs 60. Note that guide pins 42 cannot move upwardly into inner channels 94 because of steps 98 (FIG. 2).

Figure 8:
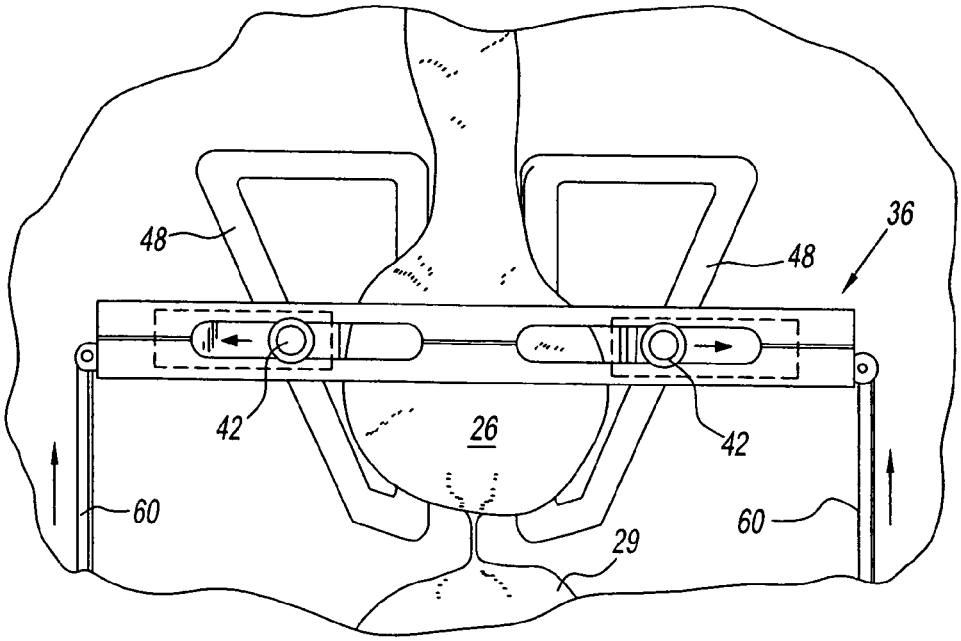
FIG. 8 is a side elevation view of a tube sealing mechanism in a partially raised position.

Referring to FIG. 8, the tube sealing mechanism 20 is shown in a partially raised position. That is, the sealing member housing 36 is shown in a partially raised position, wherein the pneumatic springs 60 are partially compressed and urging the sealing member housing 36 upwardly; the first and second sealing members 38, 40 are separated from each other because the guide pins 42 are positioned in the stepped channels 48 in outer channels 100, partially pressed into the first sealing member 38 and the second sealing member 40 because of the tapers in outer channels 100; and the first and second sealing members 38, 40 are sufficiently separated to clear the waste-filled portion of the flexible tubing 26.

Figure 9:
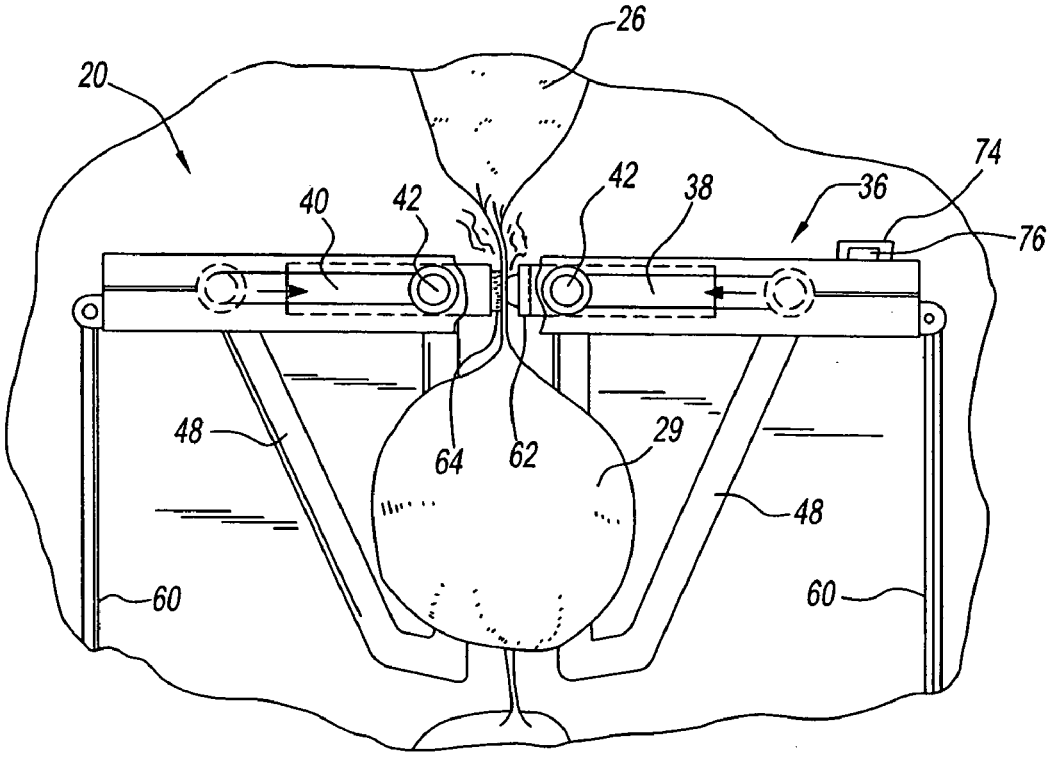
FIG. 9 is a side elevation view of a tube sealing mechanism in a raised position just after the heating elements meet.

Referring to FIG. 9, the tube sealing mechanism 20 is shown in a fully raised position. That is, the sealing member housing 36 is shown in a fully raised position, wherein the pneumatic springs 60 are fully extended, maintaining the sealing member housing 36 in the fully raised position; the first and second sealing members 38, 40 are urged together by springs 88 because the guide pins 42 had passed over steps 102 in the stepped channel 48 and thereafter followed the upper channels 92 toward the intersection of the upper channels 92 and the inner channels 94; the heating element 62 and backing element 64 are in contact and press the upper end of the waste-filled portion of the flexible tubing 26; and the magnet 76 causes the proximity switch 74 to activate timing switch 70 to provide electrical power to the heating element 62 for a predetermined amount of time to seal the flexible tubing 26. Once the timing switch 70 turns off, the heating element 62 will cool and the tube sealing mechanism is ready to begin another cycle.

It should be readily apparent to those having ordinary skill in the art that other sealing cycles can be used. For example, the sealing member housing 36 can start in the lower position (e.g., wherein the guide pins 42 are positioned at the intersection of the inner channels 94 and the lower channels 96). In such case, the pneumatic springs 60 would be of the type to bias the sealing member housing 36 downward and the guide links 46, pull bars 51, and actuation lever 54 would be configured to cause the sealing member housing 36 upward.

Figure 10:
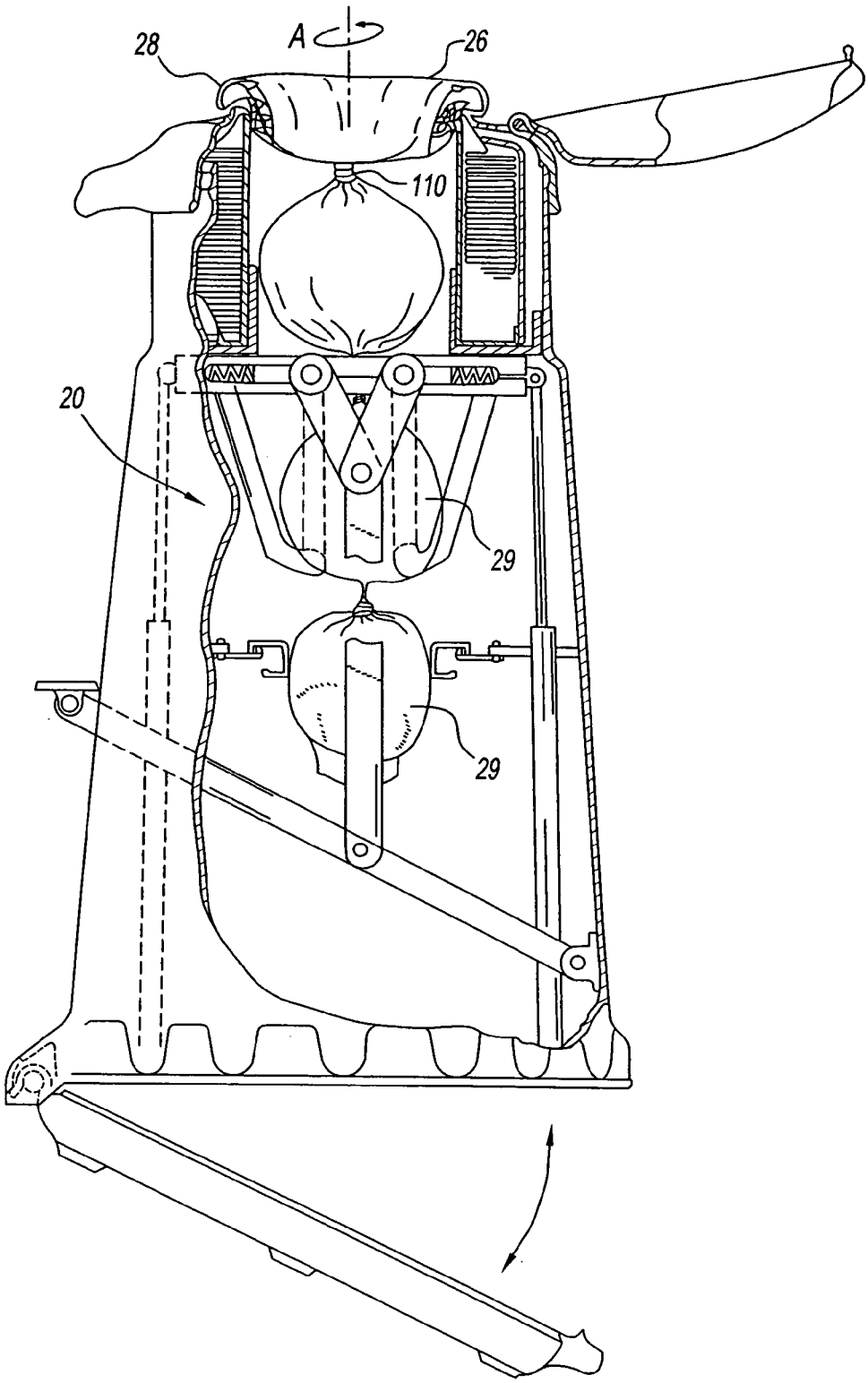
FIG. 10 is a side elevation view similar to FIG. 1, wherein an inner lid is rotated to twist one end of the flexible tubing material that contains waste prior to sealing the twisted area with a tube sealing mechanism.

Referring to FIG. 10, a side elevation view similar to FIG. 1 is shown, wherein a tube twisting mechanism 18 is used to twist flexible tubing 26. That is, the inner lid 28 is rotated in direction "A" to twist the flexible tubing material 26, thereby forming a waste package 29 prior to sealing the twisted area 110 with the tube sealing mechanism 20. A significant advantage of twisting the flexible tubing 26 prior to sealing with the tube sealing mechanism 20 is that twisting makes it possible to use a substantially shorter heating element 62 and backing element 64 (i.e., substantially shorter than length "L", FIG. 3) since the width of the area to be sealed is only as wide as the twisted area 110. In addition, twisting the flexible tubing 26 prior to sealing eliminates the need to include a tube cutting mechanism, which have been found to get clogged after repeated use, since the waste packages 29 will lie more randomly in the lower portion of the cylindrical container 12 (the wide, flat seal made between waste packages 29 that have not been twisted tend to cause the packages 29 to stack up). Furthermore, by sealing the twisted areas 110, the twisted areas will not untwist, thereby preventing the unwanted leaking of odors. Of course, it is not necessary to include a tube twisting mechanism 18 in the present invention.

Although the present invention and its advantages have been described in detail, it should be understood that various changes, substitutions and alterations can be made therein without departing from the spirit and scope of the invention as defined by the appended claims. For example, components in one figure can be combined with components shown in another figure.

What is claimed is:

1. A method for disposing of waste material comprising:

providing a length of tubing having a first sealed portion of the tubing at a location along its length and an open end of the tubing;

inserting waste material through the open end of the tubing until it contacts the first sealed portion of the tubing to form a waste package;

retaining the waste package such that the waste package does not rotate in relation to the open end of the tubing;

rotating the open end of the tubing such that a twist is formed in the tubing between the open end of the tubing and the waste package; and sealing at least a portion of the twisted tubing to form a second sealed portion by electro-thermally heating at least a portion of twisted tubing.

2. The method of claim 1, further comprising moving the length of tubing in a direction away from the open end of the tubing in preparation for the inserting of the waste material.

3. The method of claim 1, further comprising retaining the waste package by gripping a previously formed waste package such that the waste package does not rotate in relation to the open end of the tubing.

4. The method of claim 1, further comprising inserting a soiled diaper through the open end of the tubing until it contacts the first sealed portion of the tubing to form a waste package.

5. The method of claim 1, further comprising moving first and second sealing members between a position relatively close to the tubing and a position relatively further away from the tubing to selectively form the second sealed portion.

6. The method of claim 5, wherein the first and second sealing members are in a closed position as they move from the position relatively close to the tubing to the position relatively further away from the tubing.

7. The method of claim 6, wherein the first and second sealing members are in an open position as they move from the position relatively further away from the tubing to the position relatively close to the tubing.

8. The method of claim 7, further comprising actuating movement of the first and second sealing members via a proximity switch.

9. The method of claim 7, further comprising guiding the first and second sealing members to move between the open position and the closed position.

10. The method of claim 9, wherein the guiding of the first and second sealing members is via channels connected to a container that houses the tubing.

11. The method of claim 5, wherein movement of said first and second sealing members is pivotal.

12. The method of claim 5, further comprising providing a heating element operably connected with the first sealing member and a backing element operably connected with the second sealing member.

13. The method of claim 12, further comprising biasing the backing element toward the heating element.

14. The method of claim 12, further comprising storing the tubing in a cassette having an open center core.

15. The method of claim 14, wherein the tubing is dispensed from the cassette down through the open center core.

16. A method for disposing of waste material comprising:

providing a length of tubing having a first sealed portion of the tubing at a location along its length and an open end of the tubing;

inserting waste material through the open end of the tubing until it contacts the first sealed portion of the tubing to form a waste package;

retaining the waste package such that the waste package does not rotate in relation to the open end of the tubing;

rotating the open end of the tubing such that a twist is formed in the tubing between the open end of the tubing and the waste package; and moving first and second heat sealing members between a position relatively close to the tubing and a position relatively further away from the tubing to selectively form a second sealed portion of the tubing by sealing at least a portion of the twisted tubing.

17. The method of claim 16, further comprising guiding the first and second sealing members to move between open and closed positions via channels connected to a container that houses the tubing.

* * * * *